US006744347B2

(12) United States Patent
Masuda et al.

(10) Patent No.: US 6,744,347 B2
(45) Date of Patent: Jun. 1, 2004

(54) VARIABLE RESISTOR

(75) Inventors: Fumitoshi Masuda, Fukui-ken (JP); Katsuhiro Onishi, Sabae (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/109,106

(22) Filed: Mar. 28, 2002

(65) Prior Publication Data

US 2002/0163417 A1 Nov. 7, 2002

Related U.S. Application Data

(63) Continuation-in-part of application No. 09/754,427, filed on Jan. 4, 2001, now Pat. No. 6,380,841.

(30) Foreign Application Priority Data

Apr. 2, 2001 (JP) ..... 2001-102879

(51) Int. Cl.[7] ..... H01C 10/32
(52) U.S. Cl. ..... 338/162; 338/160; 338/170
(58) Field of Search ..... 337/162, 163, 337/166, 190

(56) References Cited

U.S. PATENT DOCUMENTS

| | | | | | |
|---|---|---|---|---|---|
| 3,531,753 | A | * | 9/1970 | Geese | 338/162 |
| 3,533,042 | A | * | 10/1970 | Casey et al. | 338/162 |
| 3,537,056 | A | * | 10/1970 | Van Benthoysen | 338/162 |
| 3,601,743 | A | * | 8/1971 | Mathison et al. | 338/164 |
| 3,631,371 | A | * | 12/1971 | Maurice | 338/164 |
| 3,696,385 | A | * | 10/1972 | Burns | 340/316 |
| 4,482,883 | A | * | 11/1984 | Heredero | 338/163 |
| 4,521,761 | A | | 6/1985 | Welch | |
| 4,712,084 | A | * | 12/1987 | Okazaki et al. | 338/184 |
| 4,998,088 | A | | 3/1991 | Masuda | |
| 5,043,695 | A | * | 8/1991 | Simon et al. | 338/199 |
| 5,790,012 | A | * | 8/1998 | Nakatsu et al. | 338/152 |
| 6,111,493 | A | * | 8/2000 | Onishi et al. | 338/162 |

FOREIGN PATENT DOCUMENTS

| | | |
|---|---|---|
| JP | 5-59561 | 9/1986 |
| JP | 5-0031-8 | 11/1991 |
| JP | 4-15801 | 2/1992 |
| JP | 4-68502 | 6/1992 |
| JP | 4-279006 | 10/1992 |
| JP | 5-3108 | 1/1993 |
| JP | 5-59561 | 8/1993 |
| JP | 9-35917 | 2/1997 |
| JP | 11-251116 | 9/1999 |
| JP | 11-251117 | 9/1999 |

* cited by examiner

*Primary Examiner*—Karl D. Easthom
(74) *Attorney, Agent, or Firm*—Keating & Bennett, LLP

(57) ABSTRACT

A variable resistor is constructed to reliably seal the space between a rotor and a substrate without insert-molding the substrate into a case, and to be produced at a very low cost. This variable resistor includes a hollow square-prism shaped case which is open at the top and the bottom, a substrate which is fitted into the lower opening of the case, and on the top surface of which a collector electrode and an arcuate resistor are provided, a rotor rotatably fitted into the upper opening of the case, a slider mounted on the bottom surface of the rotor and making sliding contact with the collector electrode and the resistor, an annular packing member disposed between the rotor and the substrate for sealing the space therebetween, terminals mounted on the substrate and electrically connected to the resistor and the collector electrode, and a metallic cover.

26 Claims, 8 Drawing Sheets

VARIABLE RESISTOR

This application is a Continuation-In-Part of U.S. patent application Ser. No. 09/754,427 filed on Jan. 4, 2001, now U.S. Pat. No. 6,380,841.

BACKGROUND OF THE INVENTION

1. Field of the Invention

The present invention relates to a variable resistor for use in, for example, commercial equipment such as hearing aids, measuring instruments, communication devices, and sensors, and more particularly, to a small variable resistor.

2. Description of the Related Art

As a known example of such a variable resistor, Japanese Examined Patent Application Publication No. 5-59561 discloses a variable resistor wherein a resistor substrate on which terminals are mounted is insert-molded into a resin case, a rotor on which a slider is installed and an O-ring are accommodated in the case, the rotor is prevented from rising or moving by placing a metallic cover on the case, and the cover is prevented from slipping off by engaging protrusions provided on the sides of the case with holes in leg portions provided on the cover.

As another known example of such a variable resistor, Japanese Unexamined Patent Application Publication No. 5-3108 discloses a variable resistor wherein a metallic cover is placed on a case from the upper portion thereof, and leg portions protruding from the cover are folded inwardly along the bottom surface of the case.

In both variable resistors, the rising and moving of the rotor relative to the case due to the elastic forces of an O-ring and a slider is prevented by using the metal cover.

In each of these variable resistors, the resistor substrate is insert-molded into the case to provide heat resistance and superior sealing characteristics when the variable resistor is soldered to a printed circuit board. Hence, the resistor substrate (particularly, in the case of a ceramic substrate) is prone to cracking during molding, or molding resin may flow onto the surface of the substrate on which the resistor is provided, resulting in the formation of an insulating film thereon. Furthermore, in these variable resistors, it is necessary to take special steps to prevent the resin from intruding into the inside of the substrate, in order to prevent any insulating film from being located on the surface of the substrate. These problems result in reduced productivity and increased cost.

Further, a tool engagement groove is provided in the upper surface of the rotor, and the resistance value is adjusted by rotating the rotor using a tool, such as a screwdriver, that is engaged with the tool engagement groove. However, since it is necessary to decide the location of a start point and an end point of the rotor, a stopper mechanism must be provided. In general, for variable resistors, stopper protrusions which are in contact with each other are provided on the external surface of the rotor and on the internal surface of the case, and the rotational angle of the rotor is controlled so as to be within a certain range. However, this makes the molding complicated, and the protruding portion of the rotor and the protruding portion of the case interfere with each other, and accordingly the assembly of the rotor becomes very difficult.

In response to this problem, a variable resistor having a protrusion that is integrally formed at the inner edge of an opening of a metal cover and is arranged to strike against a protrusion disposed on the upper surface of the rotor so as to control the rotational angle of the rotor, has been proposed.

However, in small variable resistors having an approximate size of about 2 mm to about 3 mm, the constituent parts also become small and thin, and accordingly it becomes difficult to obtain sufficient mechanical strength of the parts. Particularly, the thickness of metal parts becomes very small, and when the protrusion of the metal cover abuts against the protruding portion of the rotor, the metal cover is deformed and the rotation of the rotor may not be able to be sufficiently controlled.

SUMMARY OF THE INVENTION

To overcome the above-described problems, preferred embodiments of the present invention provide a variable resistor which reliably seals the space between a rotor and a substrate without insert-molding the substrate into a case, and which resistor is produced at a greatly reduced cost.

Furthermore, preferred embodiments of the present invention provide a simple and inexpensive variable resistor in which, when a stopper mechanism is provided between a metal cover and a rotor, a strong metal cover is obtained and the rotational angle of the rotor is reliably controlled.

Also, preferred embodiments of the present invention provide a variable resistor including a case which is open at the top and the bottom, a substrate which is fitted into the lower opening of the case, the substrate including a collector electrode on the top surface thereof and an arcuate resistor provided around said collector electrode, a rotor rotatably fitted into the upper opening of the case, a slider mounted on the bottom surface of the rotor and making sliding contact with the collector electrode and the resistor, an annular packing member disposed between the rotor and the substrate for sealing the space therebetween, and a metallic cover having a top plate portion for supporting the top surface of the rotor, a hole provided at the top plate portion such that a portion of the rotor is exposed, and a pair of leg portions extending downward along the sides of the case. The metallic cover supports the bottom surface of the substrate such that the metallic cover is disposed on the case from the upper portion of the case and the leg portions thereof are folded inwardly along the bottom surface of the case.

When assembling this variable resistor, first, the substrate is fitted into the lower opening of the case, and then the rotor is fitted into the upper opening of the case. It is preferable that the annular packing member be disposed on the top surface of the substrate and the slider be mounted on the bottom surface of the rotor in advance. Next, when putting the metallic cover on the case from the upper portion of the case, the pair of leg portions extend downwardly along the sides of the case. In this situation, a portion of the rotor is exposed from the window hole. The leg portions are folded inwardly along the bottom surface of the case and support the bottom surface of the substrate by the tip portions thereof. Thereby, the rotor is prevented from rising, the substrate is prevented from slipping off from the case, and the packing member and the slider are sandwiched between the rotor and the substrate. That is, a closed space is provided between the rotor and the substrate. By disposing the slider, the resistor, and the collector electrode, within this space, the intrusion of moisture and solder flux from the outside is prevented, which produces a variable resistor that achieves very stable performance.

Preferably, a spacer portion to maintain a desired spacing between the rotor and the substrate is provided on the inner surface of the case. Thereby, variations in assembly are avoided, and the compression allowance between the slider and the packing in the assembling process is uniform, and hence the electrical characteristics and the sealing characteristics of this variable resistor are very stable and uniform.

Furthermore, it is preferable that the packing member be directly applied on the top surface of the substrate, and on the outer peripheral side of the resistor. The packing member may instead be provided separately from the substrate and the rotor, and the packing may be disposed therebetween. However, in this case the packing member is prone to cause positional deviations, and it is difficult to maintain stable sealing characteristics. In contrast, the direct application of the packing onto the top surface of the substrate reliably prevents positional deviations thereof.

Moreover, guide grooves for guiding the leg portions of the metallic cover are preferably provided on the outer side-surfaces of the case. This stabilizes the positioning of the cover on the case, and facilitates the assembly thereof.

According to another preferred embodiment of the present invention, a variable resistor includes a case which is open at a top surface and a bottom surface thereof, a substrate fitted into the lower opening of the case, the substrate including a collector electrode on the top surface thereof and an arcuate resistor disposed around the collector electrode, a rotor rotatably fitted into the top opening of the case, the rotor having a tool engagement groove at an upper surface thereof, an annular groove disposed around the tool engagement groove at the upper surface thereof, and a first stopper portion provided inside the annular groove, a slider mounted on the bottom surface of the rotor, the slider including a first contact arm arranged to contact with the collector electrode and a second contact arm arranged to contact with the arcuate resistor, the first and second contact arms being integral with the slider, a metallic cover having a top plate portion supporting the top surface of the rotor, a hole provided at the top plate portion such that the tool engagement groove of the rotor is exposed, a pair of leg portions extending downwardly along two sides of the case, and a second stopper portion arranged to protrude in the inner edge of the hole of the metallic cover, the second stopper portion being bent downward to be inserted into the annular groove of the rotor so as to control the rotational angle of the rotor by abutting the first stopper portion, wherein the metallic cover supports the bottom surface of the substrate such that the metallic cover is placed on the case from the upper portion of the case and the leg portions thereof are folded inwardly along the bottom surface of the case.

The substrate is fitted into the lower opening of the case, the rotor having the slider attached thereto is accommodated in the case from above, the metallic cover is placed on the case from above, and the lower surface of the substrate is supported by bending inwardly the leg portions of the metallic cover on the bottom surface of the case. Thus, the top plate portion of the metallic cover prevents rising of the rotor, and at the same time, the substrate is prevented from falling off. In this way, it is not necessary to fix the substrate to the case in advance. Also, since the case, the rotor, and the substrate are held together by the metallic cover, the assembly is simple, and moreover, since the shape of the case is simplified, the manufacturing cost is reduced.

The annular groove is preferably located in the upper surface of the rotor, and the second stopper portion of the metallic cover, which is bent downward in the inner edge of the hole of the metallic cover, is inserted into the annular groove of the rotor. When the rotor is rotated, the first stopper portion of the rotor disposed inside the annular groove abuts against the second stopper portion of the metallic cover, and then the rotor stops. At this time, if the rotor is strongly rotated, a bending stress acts on the second stopper portion and it may be possible that the rotation of the rotor cannot be controlled due to deformation of the second stopper portion. However, since the second stopper portion is inserted in the annular groove of the rotor, the bending deformation in the thickness direction of the second stopper portion is controlled by the annular groove. Dropping off of the second stopper portion of the metallic cover from the first stopper portion of the rotor is prevented. Therefore, even if the metallic cover is made of a thin metal, the rotational angle of the rotor is reliably controlled.

According to a preferred embodiment of the present invention, a burring portion curved towards the annular groove of the rotor is provided in the inner edge of the hole of the metallic cover, and the upper surface of the rotor may be located under the top plate portion of the metallic cover. That is, when the burring portion is provided and the upper surface of the rotor is located lower than the top plate portion of the metallic cover, the burring portion functions as a guide when a screwdriver is inserted, and the lead to the tool engagement groove is improved. Furthermore, the burring portion improves the strength of the top plate portion of the metallic cover and has the advantage of reinforcing the second stopper portion.

According to preferred embodiments of the present invention, it is preferable that the second stopper portion of the metallic cover is provided in the vicinity of the leg portions. If the second stopper portion is provided in the vicinity of the leg portions, when the rotation of the rotor is controlled by the second stopper portion engaged in the rotor, the rigidity against deformation of the cover is further improved. Even if the metallic cover is made of a thin metal, the rotational angle of the rotor is effectively controlled.

The features, characteristics, elements and advantages of the present invention will be clear from the following detailed description of preferred embodiments of the invention in conjunction with the accompanying drawings.

BRIEF DESCRIPTION OF THE DRAWINGS

FIGS. 2A through 2C are diagrams illustrating the variable resistor shown in FIG. 1, wherein FIG. 2A is a plan view thereof, FIG. 2B is a front view thereof, and FIG. 2C is a bottom view thereof;

FIGS. 6A through 6C are diagrams illustrating a rotor in accordance with preferred embodiments of the present invention, wherein FIG. 6A is a plan view thereof, FIG. 2B is a sectional view taken along a line Z—Z in FIG. 6A, and FIG. 6C is a bottom view of the rotor;

DETAILED DESCRIPTION OF PREFERRED EMBODIMENTS

Figure 1:
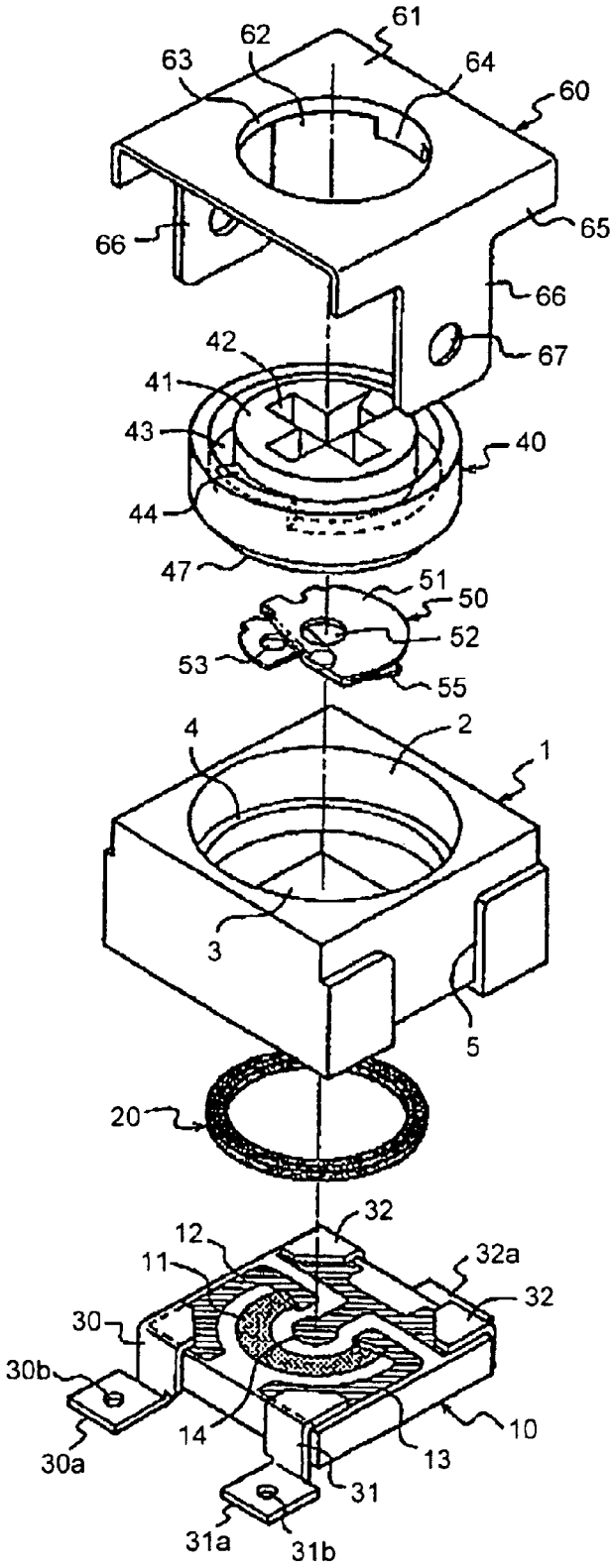
FIG. 1 is an exploded perspective view showing a preferred embodiment of a variable resistor in accordance with the present invention.
Figure 2A:
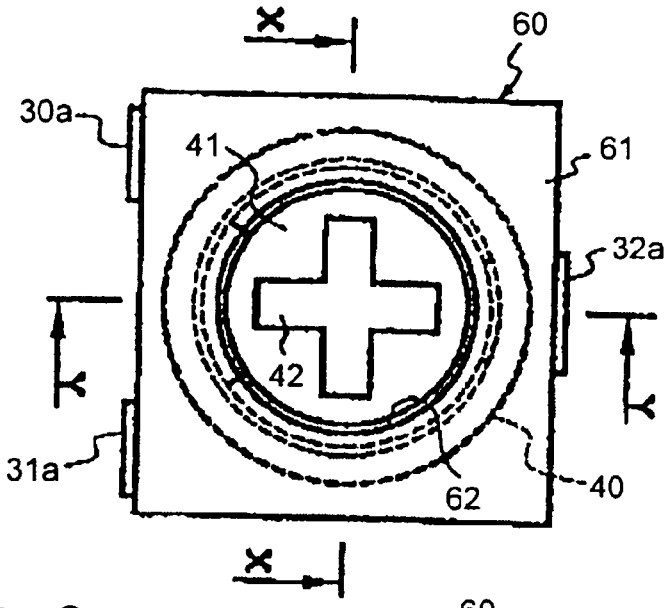
Figure 2B:
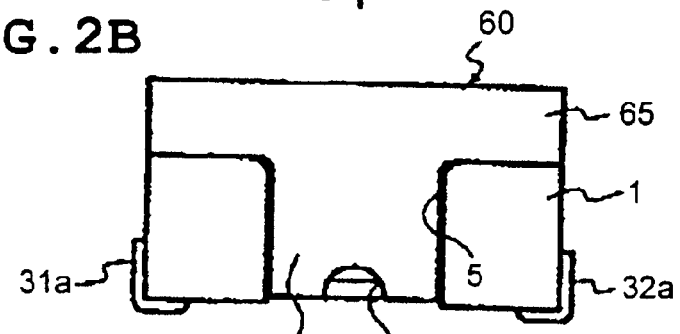
Figure 2C:
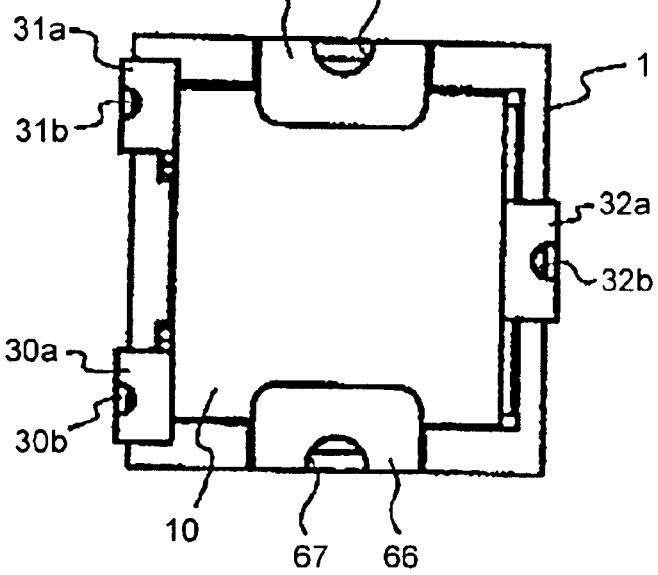

FIGS. 1 through 8D shows a preferred embodiment of a variable resistor in accordance with the present invention.

This variable resistor includes a case 1, a resistor substrate 10, a packing 20, lead terminals 30 through 32, a rotor 40, a slider 50, a metallic cover 60 or the like.

The case 1 is made of a thermoplastic resin such as a heat-resistant polyamide, e.g., 46 nylon, polyphenylene sulfide, polybutylene terephthalate, or a liquid-crystal polymer, or a thermosetting resin such as an epoxy resin, diarylphthalate, or an unsaturated polyester, to withstand the soldering heat, and to allow a stable operation under high-temperature conditions. The case 1 preferably has a substantially cylindrical shape which is open at the top and the bottom, and has a substantially circular upper opening 2 provided at the upper portion thereof and a substantially rectangular lower opening 3 provided at the lower portion thereof. An annular spacer portion 4 for securing a desired spacing for disposing the packing 20 between the rotor 40 and the resistor substrate 10 protrudes from the inner surface at the intermediate portion in the vertical direction. Guide grooves 5 are provided on two opposing outer side-surfaces of the case 1.

The resistor substrate 10 is fitted in the lower opening 3 of the case 1. The resistor substrate 10 is defined by a substantially rectangular plate using a ceramic material such as alumina, or a heat-resistant resin such as polyphenylene sulfide or a liquid-crystal polymer. As shown in FIG. 5, a substantially C-shaped resistor 11, made of, for example, a cermet resistor or a carbon resistor, is provided on the top surface of the resistor substrate 10 by a method such as screen printing or transfer. Both ends of the resistor 11 are extended out to one side-edge of the substrate 10 via electrodes 12 and 13 provided on the substrate 10. Also, a collector electrode 14 positioned at the approximate center of the resistor 11 is provided on the top surface of the substrate 10, and is led out to the other side-edge of the substrate 10. The depth in which the resistor substrate 10 is fitted into the case 1 is determined to abut the top surface of the resistor substrate 10 against the bottom surface of the spacer portion 4 provided on the inner surface of the case 1 (see FIGS. 3 and 4).

On the top surface of the substrate 10, the packing member 20 is formed as an annulus which exerts a stable packing effect while being subjected to the soldering heat or variations in the operating temperature and which has superior electrical insulating characteristics. Specifically, silicone rubber, fluorine rubber, or fluorosilicone rubber is directly applied and cured on the top surface of the resistor substrate 10 to surround the resistor 11.

To both side-edges of the resistor substrate 10 where the electrodes 12 and 13 and the collector electrode 14 are led out, three lead terminals 30, 31, and 32 are affixed via welding, thermal pressure-contact by a heater chip, or soldering, and are electrically connected to the electrodes 12, 13, and 14, respectively. Particularly, the lead terminals 32 together define a fork shape, and are connected to the lead-out portions of the collector electrode 14 at two points. External connecting portions 30*a* through 32*a* of the lead terminals 30 through 32 are led out from surfaces other than the sides on which the guide grooves 5 of the case 1 are provided, and are folded upward along the outer side-surfaces of the case 1. To facilitate folding the external connecting portions 30*a* through 32*a*, holes 30*b* through 32*b* are provided in the external connecting portions 30*a* through 32*a*. Alternatively, the external connecting portions 30*a* through 32*a* may be led out in the horizontal direction without being folded.

The rotor 40 is made of a heat-resistant resin, such as polyphenylene sulfide or a liquid-crystal polymer, into a substantially columnar shape, and is rotatably fitted into the upper opening 2 of the case 1. A columnar boss portion 41 protrudes at the approximate central portion of the top surface of the rotor 40. On the top surface of this boss portion 41, a cross-shaped tool-engaging groove 42 with which a tool such as a driver is engaged is provided. An annular groove 43 is provided on the outer periphery of the boss portion 41, and a stopper 44 is provided at a desired position of the annular groove 43. The stopper 44 may be disposed inside the annular groove 43. A protrusion 45 for positioning is provided at the approximate central portion of the bottom surface of the rotor 40, and a detent protrusion 46 (see FIGS. 6B and 6C) is provided at an eccentric position of the bottom surface. An annular wall 47 protrudes to surround the above-mentioned protrusions 45 and 46. The annular wall 47 contacts the packing 20 provided on the resistor substrate 10, and defines a closed space 21 (see FIGS. 3 and 4) between the rotor 40 and the resistor substrate 10. It is to be noted that, when the rotor 40 is fitted into the upper opening 2 of the case 1, the spacing between the rotor 40 and the resistor substrate 10 is uniform due to the abutting of the bottom surface of the rotor 40 against the top surface of the spacer portion 4, resulting in a uniform compression allowance (described below) between the slider 50 and the packing 20.

The slider 50 is preferably made of a material having superior spring characteristics and electrical conductivity, such as copper alloy, stainless steel, or noble-metal-based alloy, and has a substantially disk-shaped base portion 51 provided on the top side thereof. As shown in FIGS. 8A through 8D, holes 52 and 53 to fit into the protrusions 45 and 46 of the rotor 40 are provided in the base portion 51. The slider 50 is affixed to the rotor 40 and prevented from rotating with respect to the rotor 40. Here, the slider 50 is fixed via thermal-caulking the protrusions 45 and 46 after fitting the holes 52 and 53 of the slider 50 to the protrusions 45 and 46.

On the outer peripheral portion of the base 51, an arm-shaped central contact-point portion 54 and a comb shaped sliding contact-point portion 55 are continuously provided, and these contact-point portions 54 and 55 are folded back below the base portion 51. Meanwhile, in FIG. 8, the two-dot chain lines indicate free positions of the central contact-point portion 54 and the sliding contact-point portion 55. The central contact-point portion 54 elastically presses against the collector electrode 14, and the sliding contact-point portion 55 elastically presses against the resistor 11.

Instead of the above-described configuration, another slider can be used as shown in FIGS. 9A–9D. A first substantially linear contacting arm 54 and a second arc-shaped contacting arm 55 are integrally disposed around the base portion 51, and the first and second contacting arms 54 and 55 are folded back on the lower side of the base portion 51. A single contact point 54*a*, which is elastically in contact with the collector electrode 14 of the resistor substrate 10, is located at the tip portion of the first contacting arm 54. The tip portion of the second contacting arm 55 is split like the teeth of a comb, and a plurality of contact points 55*a*, which are elastically in contact with the resistor 11 of the resistor substrate 10, are disposed at its tip portion. Moreover, in FIG. 9, the two-dot chain lines show free positions of the contacting arms 54 and 55, and the solid lines show the positions when the contacting arms 54 and 55 are in contact with the resistor substrate 10 while pressing against the resistor substrate 10.

The metallic cover 60 is preferably made of stainless steel or a copper alloy such as nickel silver, which are both rust-proof and have non-solder wettable characteristics. The cover 60 includes a top plate 61 disposed on the top surface of the case 1 to prevent the rotor 40 from rising. At the approximate center of the cover 60, a substantially circular window hole 62 is provided from which the columnar boss portion 41 of the rotor 40 is exposed.

The inner edge portion 63 of the window hole 62 is folded downward to define a burring portion, and is inserted into the annular groove 43 of the rotor 40. As shown in FIG. 1, a stopper member 64 which protrudes downward is provided at one portion of the inner edge portion or burring portion 63. The rotational angle of the rotor 40 is limited by the stopper member 64 abutting against the stopper portion 44 of the annular groove 43.

Figure 3:
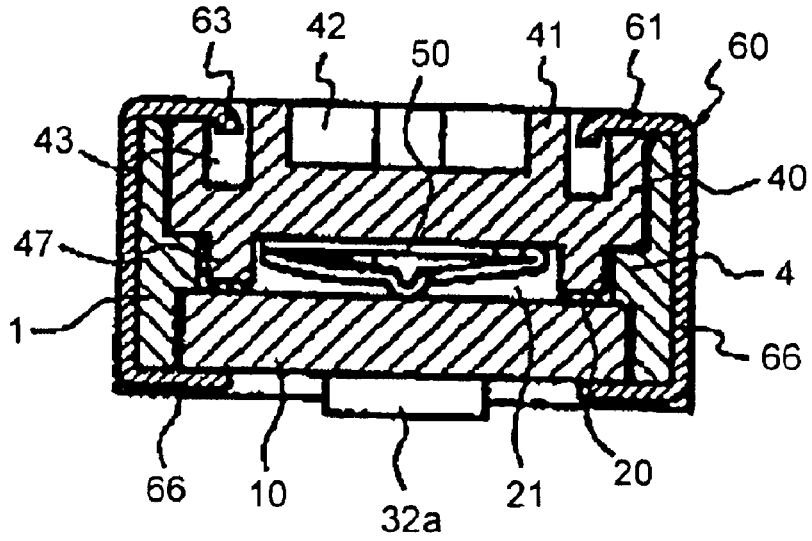
FIG. 3 is a sectional view taken along a line X—X in FIG. 2A.
Figure 4:
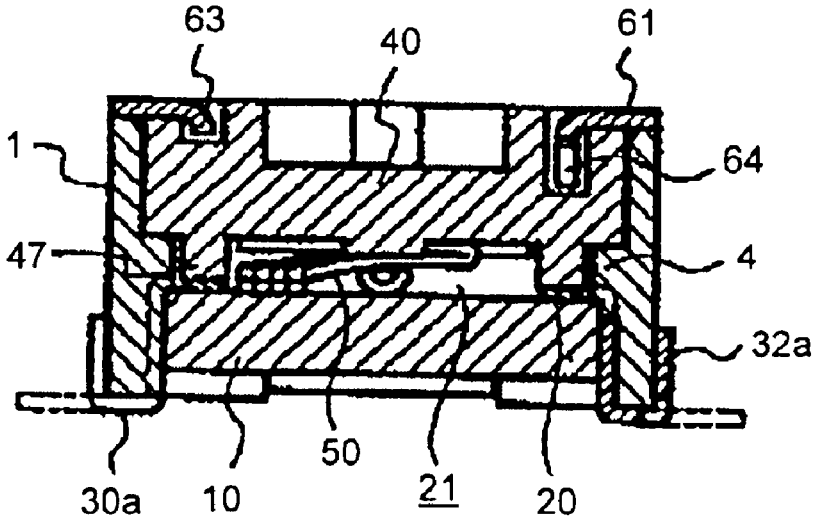
FIG. 4 is a sectional view taken along a line Y—Y in FIG. 2A.
Figure 5:
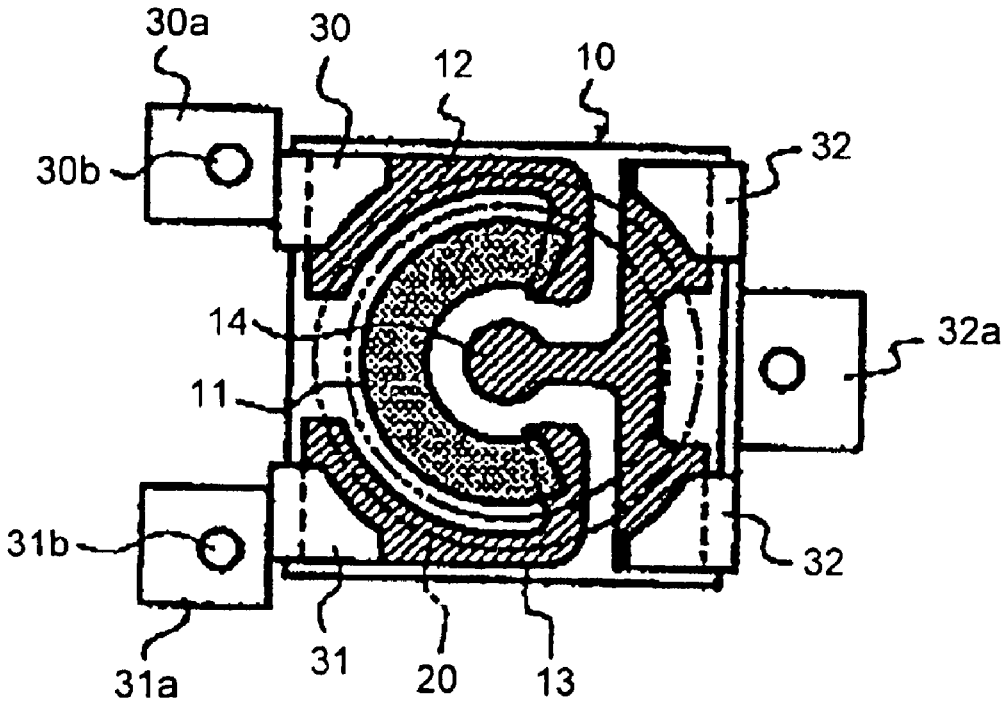
FIG. 5 is a plan view showing a resistor substrate in accordance with a preferred embodiment of the present invention.
Figure 6A:
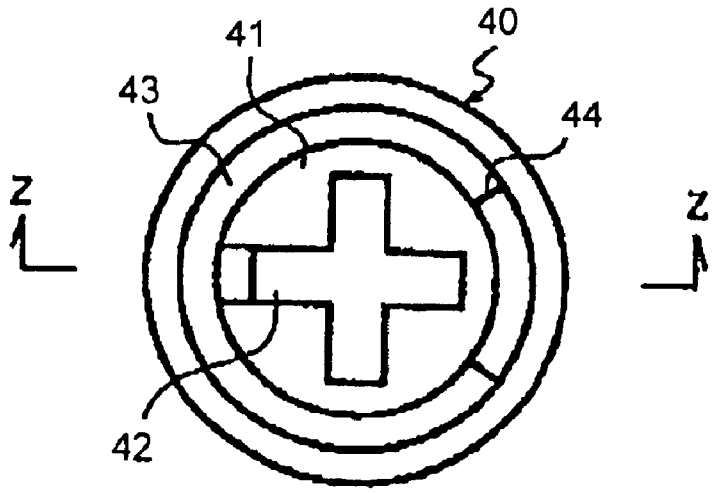
Figure 6B:
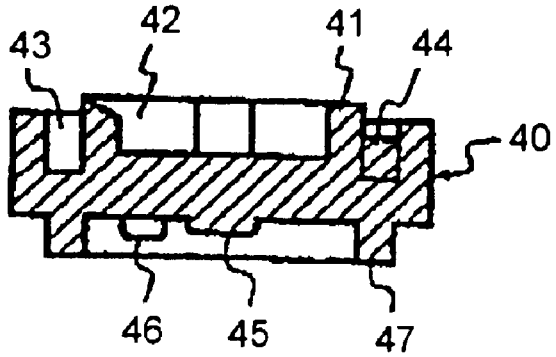
Figure 6C:
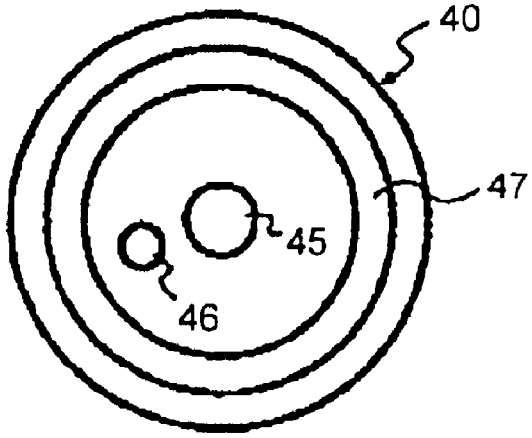
Figure 7:
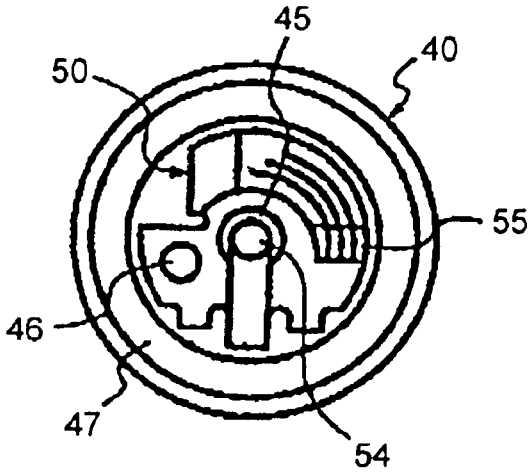
FIG. 7 is a bottom view illustrating the rotor shown in FIGS. 6A through 6C on which a slider in accordance with preferred embodiments of the present invention has been mounted.
Figure 8A:
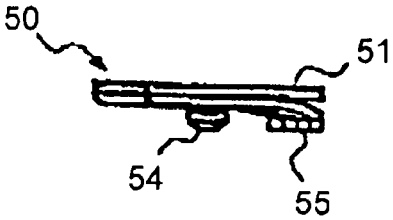
FIGS. 8A through 8D illustrate a plan view, a front view, a left-side view, and right-side view of the slider shown in FIG. 7.
Figure 8C:
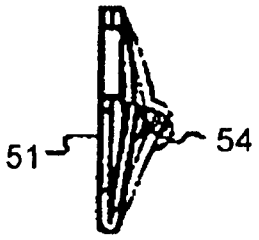
Figure 8B:
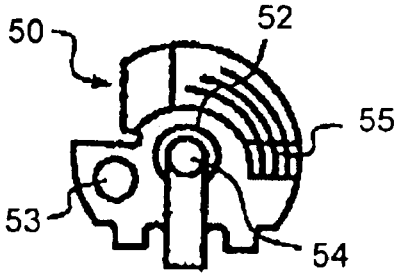
Figure 8D:
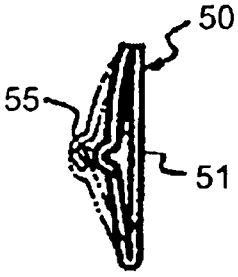
Figure 9A:
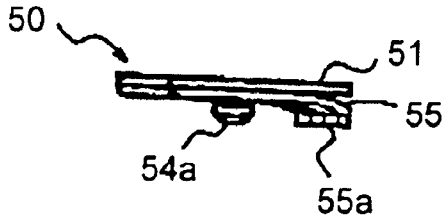
FIGS. 9A through 9D illustrate a plan view, a front view, a left-side view, and right-side view of the slider shown in FIG. 7.
Figure 9C:
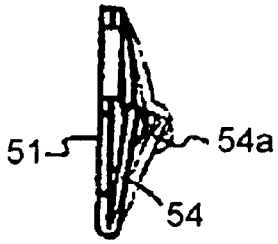
Figure 9B:
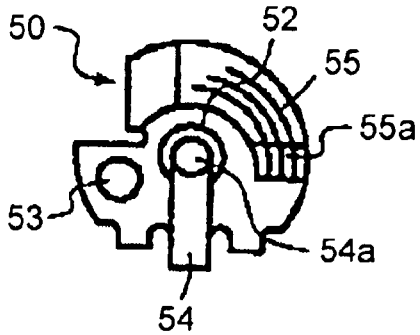
Figure 9D:
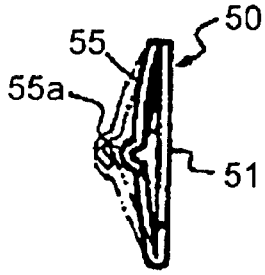
Figure 10:
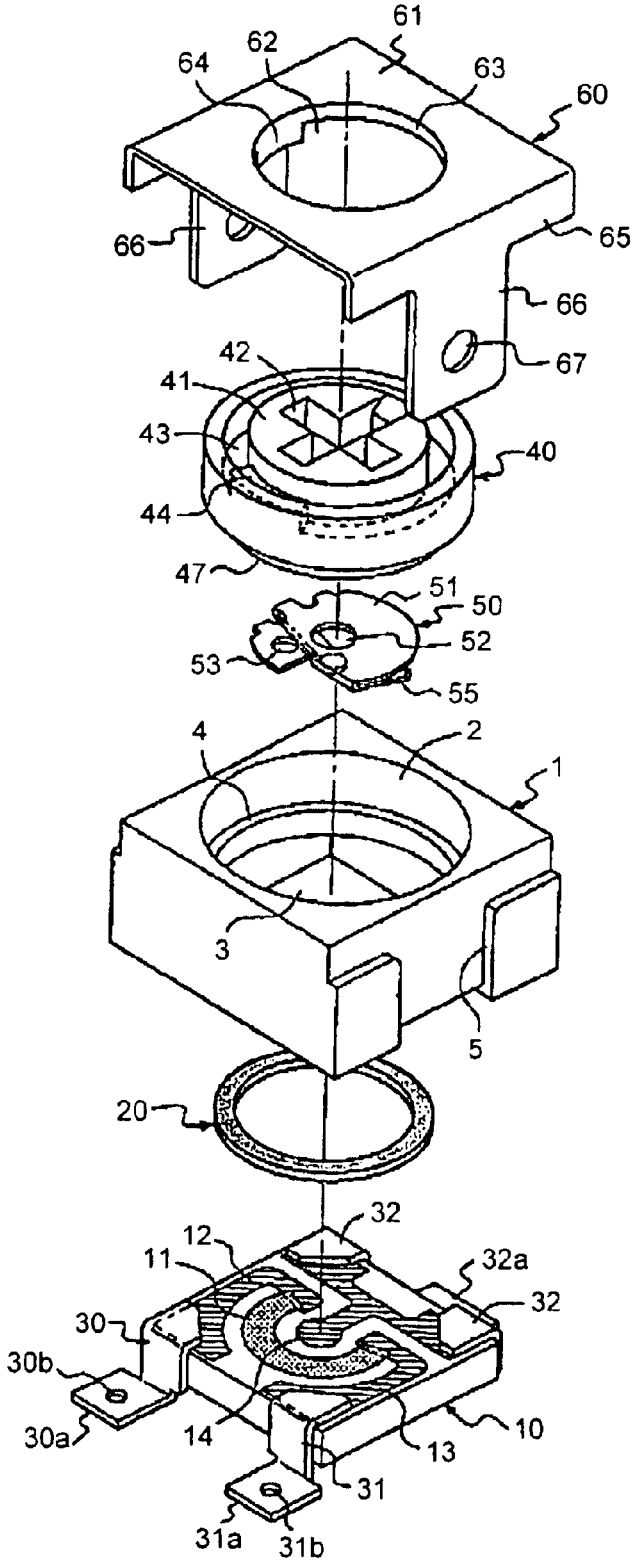
FIG. 10 is an exploded perspective view showing a preferred embodiment of a variable resistor in accordance with the present invention.

More specifically, as shown in FIGS. 3 and 4, the burring portion 63 that is bent downward at the inner edge of the hole 62 is provided, and the bent inner edge portion defining the burring portion 63 is inserted in the annular groove 43 of the rotor 40. A long stopper member 64 protruding downward is disposed along a portion of the burring portion 63, and the rotating angle of the rotor 40 is controlled such that the stopper member 64 is inserted in the annular groove 43 and abuts against the side surface of the stopper 44. As shown in FIG. 10, the stopper member 64 of the metal cover 60 is provided in the vicinity of the leg portions 66.

Skirt portions 65 are provided, each having the same width and extending along two sides of the top plate 61, and tongue-shaped leg portions 66 are provided, each protruding downward from the lower edges of these skirt portions 65. When the cover 60 is placed on the case 1, the leg portions 66 are engaged with the guide grooves 5 of the case 1 and protrude below the bottom surface of the case 1. Then, by folding the tip of each of the leg portions 66 inward along the bottom surface of the case 1, the cover 60 is affixed to the case 1. In this preferred embodiment, to facilitate folding the leg portions 66 inward, the leg portions 66 are provided with holes 67.

Next, the method for assembling the variable resistor in accordance with the above-described preferred embodiment will be described.

First, the resistor substrate 10 is fitted into the lower opening 3 of the case 1. The lead terminals 30 through 32 are fixed on the resistor substrate 10 and the packing member 20 is applied beforehand. Then, the rotor 40 is fitted into the upper opening 2 of the case 1. At this time, since the slider 50 has been mounted on the bottom surface of the rotor 40, the rotor 40 is lifted off from the case 1.

Next, the metallic cover 60 is placed on the case 1, and the leg portions 66 of the cover 60 are each inserted into the guide grooves 5 on the side surfaces of the case 1. Then, by folding inward the legs 66 protruding downward from the lower end surface of the case 1, the led portions 66 are engaged with the bottom surface of the case 1. Thereby, the top plate portion 61 of the cover 60 presses down the top surface of the rotor 40, and causes the bottom surface of the rotor 40 to abut, or substantially abut, against the top surface of the spacer portion 4. Simultaneously, the leg portions 66 support the bottom surface of the resistor substrate 10, and press the top surface of the resistor substrate 10 on the bottom surface of the spacer portion 4. As a result, all components including the rotor 40 and the resistor substrate 10 are integrally assembled in the case 1, the spacing between the rotor 40 and the resistor substrate 10 is maintained substantially uniform, and the compression allowances between the slider 50 and the packing 20 is uniform. In other words, the sealing pressure of the packing 20 is uniform. Thus, variations in sealing characteristics are eliminated, and also the spring pressure of the slider 50 is uniform, which results in very stable electrical characteristics.

In the variable resistor thus assembled, by rotating the rotor 40 with the tip of a driver engaged with the tool-engaging groove 42, the sliding contact-point portion 55 slides on the resistor 11 while the approximately central contact-point portion 54 is kept in contact with the collector electrode 14. This allows the resistance between the terminal 30 and the terminal 32, and that between the terminal 31 and the terminal 32 to be adjusted. When the rotor is stopped at a desired position, the rotation of the rotor 40 is limited by the frictional force of the packing 20, and hence deviation of the contact position between the resistor 11 and the sliding contact-point portion 55 is greatly suppressed, whereby the resistance value is stabilized.

Furthermore, when the rotor 40 is rotated by a screwdriver, since the upper surface of the rotor 40 is lower than the top plate portion 61 of the metal cover 60 and the burring portion 63 is disposed along the inner edge of the opening window 62 of the metal cover 60, the screwdriver is led inside by the burring portion 63 and is easily engaged in the tool engagement groove 42.

When the rotor 40 is rotated in either direction of rotation, the rotational angle of the rotor 40 is controlled such that the stopper member 64 disposed in the metal cover 60 strikes the stopper portion 44 of the annular groove 43 of the rotor 40. At this time, if the rotor 40 is strongly rotated by a screwdriver, a bending stress acts on the stopper member 64 and it is possible that the stopper member 64 is deformed. Particularly, when the variable resistor is small, the plate thickness of the metal cover 60 is very thin and the strength is low. However, since the stopper member 64 is inserted in the annular groove 43, when a bending stress acts on the stopper member 64, the stopper member 64 is only deformed along the inner surface of the annular groove 43 and it is not possible that the stopper member 64 turns past the stopper portion 44. Accordingly, the rotational angle of the rotor 40 can be reliably controlled.

The variable resistor in accordance with the present invention is not limited to the above-described preferred embodiments, but may be modified within the spirit of the invention.

In the above-described preferred embodiments, although the example wherein the packing member 20 is affixed on the resistor substrate 10 is described, the present invention is not restricted to this configuration. For example, the sealing between the rotor 40 and the resistor substrate 10 may be performed by fitting an O-ring to the lower end of the rotor 40, and by pressing this O-ring against the resistor substrate 10.

Also, in the above-described preferred embodiments, the lead terminals 30 through 32 are fixed to the resistor substrate 10, and thereby a surface-mount type variable resistor is produced. However, a variable resistor with lead terminals may be formed by configuring the lead terminals to protrude downward. Alternatively, the lead terminals may be omitted by leading out the electrodes 12 through 14 to the bottom surface side of the substrate 10.

In the above-described preferred embodiments, an example where the packing member 20 is disposed between the resistor substrate 10 and the rotor 40 to seal the gap between them is shown, but the construction of the present invention is not limited to this. The gap between the rotor 40 and the case 1 is preferably sealed by using, for example, an O ring or other suitable element, and the gap between the resistor substrate 10 and the case 1 may be sealed by an adhesive or insert molding. In the above-described preferred embodiment, the case 1 is preferably a substantially cylindrical tube both top and bottom surfaces of which are open. After the resistor substrate 10 has been fitted from the bottom, the leg portions 66 of the metal cover 60 are bent on the bottom surface of the case 1 to support the lower surface of the resistor substrate 10, but the resistor substrate 10 is fixed to the case 1, and the metal cover 60 is prevented from falling off because the leg portions of the metal cover 60 are engaged in the side surface of the case 1.

The tool engagement groove 42 of the rotor 40 is not limited to the cross-shaped one, and it may be minus-shaped or have another suitable shape.

As is evident from the above-described description, in accordance with various preferred embodiments of the present invention, all components including the rotor and the resistor substrate are integrally assembled in the case by providing the pair of leg portions for the metallic cover placed on the case from the upper portion of the case, and by folding these legs inward along the bottom surface of the case. Therefore, unlike conventional examples, it is essential only that the substrate be fitted into the lower opening of the case without insert-molding the substrate into the case. This leads to a significant reduction in the production cost.

Furthermore, since the rotor and the substrate press against each other with the packing interposed therebetween by folding the leg portions of the metallic cover, a closed space in which the slider is disposed is provided therebetween. This prevents the intrusion of moisture and solder flux from the outside, and thereby allows a stable electrical performance of this variable resistor to be maintained.

As clearly understood in the above description, according to the aspect of various preferred embodiments of the present invention, since a variable resistor is configured such that, after a substrate has been fitted into the lower opening portion of a case and a rotor and a slider have been assembled from above, a metal cover is mounted from above and leg portions are bent on the side of the lower surface of the case, it is not necessary to fix the substrate in the case in advance, and the case, the rotor, and the substrate can be integrally held. Therefore, the assembly is simple, the shape of the case can be simplified, and the manufacturing cost can be reduced. Furthermore, an annular groove is preferably disposed in the upper surface of the rotor and at the same time a stopper portion is disposed inside the annular groove, a stopper member which is inserted in the annular groove of the rotor is formed by bending the stopper member downward at the internal edge portion of the window opening of the metal cover, and the rotational angle of the rotor is controlled by making the stopper member contact with the stopper portion of the rotor. Accordingly, even if the rotor is strongly rotated, the bending deformation of the stopper member is controlled by the annular groove and the stopper member can be prevented from turning past the stopper portion of the annular groove. Therefore, even if the metal cover is made of a thin metal, the rotational angle of the rotor can be reliably controlled. Furthermore, since the stopper mechanism is disposed between the rotor and the metal cover, the molding is simple compared with the case where the mechanism is disposed between the rotor and the case, and the assembly of the rotor is very easy.

While the present invention has been described with reference to the preferred embodiments, it is to be understood that various changes and modifications may be made thereto without departing from the invention in its broader aspects and therefore, it is intended that the appended claims cover all such changes and modifications as fall within the scope of the invention.

What is claimed is:

1. A variable resistor comprising:

a case which is open at a top surface and a bottom surface thereof;

a substrate fitted into the lower opening of the case, the substrate including a collector electrode on the top surface thereof and an arcuate resistor disposed around said collector electrode;

a rotor rotatably fitted into the top opening of the case, said rotor having a tool engagement groove at an upper surface thereof, an annular groove disposed around the tool engagement groove at the upper surface thereof, and a first stopper portion provided inside of the annular groove;

a slider mounted on the bottom surface of the rotor, said slider including a first contact arm arranged to contact with said collector electrode and a second contact arm arranged to contact with said arcuate resistor, the first and second contact arms being integral with said slider;

a metallic cover including a top plate portion supporting the top surface of the rotor, a hole provided at said top plate portion such that said tool engagement groove of the rotor is exposed, a pair of leg portions extending downward along two sides of the case, and a second stopper portion arranged to protrude in the inner edge of the hole of the metallic cover, said second stopper portion being bent downward so as to be inserted into the annular groove of the rotor to control the rotational angle of the rotor by abutting against the first stopper portion;

wherein said metallic cover supports the bottom surface of the substrate such that the metallic cover is placed on the case from the upper portion of the case and the leg portions thereof are folded inwardly along the bottom surface of the case.

2. A variable resistor as claimed in claim 1, wherein a burring portion that is curved toward the annular groove of the rotor is provided in the inner edge of the hole of the metallic cover, and the upper surface of the rotor is located under the top plate portion of the metallic cover.

3. A variable resistor as claimed in claim 1, wherein the second stopper portion of the metallic cover is provided in the vicinity of the leg portions.

4. A variable resistor as claimed in claim 1, further comprising an annular packing member disposed between the rotor and the substrate, the annular packing member arranged to seal the space therebetween.

5. A variable resistor as claimed in claim 4, wherein said packing member is directly applied on the top surface of the substrate, and on the outer peripheral side of the arcuate resistor.

6. A variable resistor as claimed in claim 1, wherein a spacer portion is arranged to maintain a desired spacing between the rotor and the substrate and is provided on the inner surface of said case.

7. A variable resistor as claimed in claim 1, wherein a guide groove to guide each of the leg portions of the metallic cover is provided on the outer surface of said case.

8. A variable resistor as claimed in claim 1, wherein each of said leg portions includes a hole to accommodate the inward folding of said leg portions.

9. A variable resistor as claimed in claim 1, wherein said case is made of a thermoplastic resin.

10. A variable resistor as claimed in claim 1, wherein said case is made of a heat-resistant polyamide.

11. A variable resistor as claimed in claim 1, wherein said case has a substantially cylindrical shape.

12. A variable resistor as claimed in claim 1, wherein said substrate further includes at least two electrodes which extend out to side edges of said substrate.

13. A variable resistor comprising:

a case which is open at a top surface and a bottom surface thereof;

a resistor substrate fitted into the lower opening of the case;

a rotor rotatably fitted into the top opening of the case, said rotor having a tool engagement groove at an upper surface thereof, an annular groove disposed around the tool engagement groove at the upper surface thereof; and a metallic cover having a top plate portion for supporting the top surface of the rotor, a hole provided at said top plate portion such that said tool engagement groove of the rotor is exposed, and a pair of lea portions extending downward along two sides of the case;

wherein the metallic cover supports the bottom surface of the resistor substrate such that the metallic cover is placed on the case from the upper portion of the case and the leg portions thereof are folded inward along the bottom surface of the case.

14. A variable resistor as claimed in claim 13, further comprising:

a slider mounted on the bottom surface of the rotor, said slider including a first contact arm arranged to contact with a first portion of the said resistor substrate and a second contact arm arranged to contact with a second portion of said resistor substrate, the first and second contact arms being integral with said slider.

15. A variable resistor as claimed in claim 13, wherein the resistor substrate includes a collector electrode on the top surface thereof and an arcuate resistor disposed around said collector electrode.

16. A variable resistor as claimed in claim 15, wherein said first contact arm of said slider makes contact with said collector electrode and said second contact arm of said slider makes contact with said arcuate resistor.

17. A variable resistor as claimed in claim 13, wherein a spacer potion is arranged to maintain a desired spacing between the rotor and the resistor substrate and is provided on the inner surface of said case.

18. A variable resistor as claimed in claim 13, further comprising an annular packing member disposed between the rotor and an arcuate resistor on the substrate, the annular packing member arranged to seal the space therebetween.

19. A variable resistor as claimed in claim 18, wherein said packing member is directly applied on the top surface of the resistor substrate, and on the outer peripheral side of the arcuate resistor.

20. A variable resistor as claimed in claim 13, wherein a guide groove to guide each of the leg portions of the metallic cover is provided on the outer surface of said case.

21. A variable resistor as claimed in claim 13, wherein each of said leg portions includes a hole to facilitate the inward folding of said leg portions.

22. A variable resistor as claimed in claim 13, wherein said case is made of a thermoplastic resin.

23. A variable resistor as claimed in claim 13, wherein said case is made of a heat-resistant polyamide.

24. A variable resistor as claimed in claim 13, wherein said case has a substantially cylindrical shape.

25. A variable resistor as claimed in claim 16, wherein the rotor includes a first stopper portion provided inside of the annular groove.

26. A variable resistor as claimed in claim 25, wherein the metallic cover includes a second stopper portion arranged to protrude in the inner edge of the hole of the metallic cover, said second stopper portion being bent downward so as to be inserted into the annular groove of the rotor to control the rotational angle of the rotor by abutting against the first stopper portion.

* * * * *